United States Patent [19]

Hasegawa

[11] Patent Number: 4,641,401

[45] Date of Patent: Feb. 10, 1987

[54] SOCKET FOR SNAP FASTENER

[75] Inventor: Yoshihiko Hasegawa, Kawasaki, Japan

[73] Assignee: Scovill Japan Kabushiki Kaisha, Tokyo, Japan

[21] Appl. No.: 771,333

[22] Filed: Aug. 30, 1985

Related U.S. Application Data

[63] Continuation-in-part of Ser. No. 593,334, Mar. 26, 1984, abandoned.

[30] Foreign Application Priority Data

May 9, 1983 [JP] Japan ..... 58-67843

[51] Int. Cl.[4] ..... A41F 1/02

[52] U.S. Cl. ..... 24/681; 24/108; 24/662; 24/113 MP

[58] Field of Search ..... 24/108, 662, 664, 681, 24/113 R, 113 MP; 593/334

[56] References Cited

U.S. PATENT DOCUMENTS

| | | | |
|---|---|---|---|
| 2,129,825 | 10/1938 | Dews | 24/681 X |
| 2,312,443 | 3/1943 | Reiter | 24/681 X |
| 2,724,162 | 11/1955 | Fenton | 24/681 |
| 2,771,652 | 11/1956 | Barratt | 24/681 |
| 2,771,653 | 11/1956 | Carpinella | 24/681 |

FOREIGN PATENT DOCUMENTS

| | | | |
|---|---|---|---|
| 0073477 | 8/1982 | European Pat. Off. . | |
| 76979 | 8/1894 | Fed. Rep. of Germany | 24/662 |
| 9775 | of 1891 | United Kingdom | 24/108 |
| 4058 | of 1910 | United Kingdom | 24/108 |
| 0558199 | 12/1943 | United Kingdom . | |
| 810266 | 3/1959 | United Kingdom . | |
| 830194 | 3/1960 | United Kingdom . | |
| 1203653 | 9/1970 | United Kingdom . | |
| 1390796 | 4/1975 | United Kingdom . | |
| 1543693 | 4/1979 | United Kingdom . | |

*Primary Examiner*—James T. McCall
*Assistant Examiner*—Laurie K. Cranmer
*Attorney, Agent, or Firm*—Panitch Schwarze Jacobs & Nadel

[57] ABSTRACT

A socket constituting the female member of a snap fastener, which comprises a metal spring button part including an annular base, an inner portion extending inwardly and downwardly from the inner portion of said annular base, and further extending inwardly and upwardly and split into flaps which terminate with tongues arranged circularly for elastic engagement with a stud as the male member of the snap fastener, an outer portion curvedly extending outwardly and downwardly from the outer portion of said annular base and then inwardly to form portions to guide and receive the legs of a backing member of the snap fastener, and a cover plate having a circular opening of a larger diameter than the inside diameter of the circle defined by said tongues, said cover plate being secured to the periphery on the tongue side of said annular base.

4 Claims, 3 Drawing Figures

SOCKET FOR SNAP FASTENER

CROSS REFERENCE TO RELATED APPLICATION

This is a continuation-in-part of my co-pending U.S. application Ser. No. 593,334 filed Mar. 26, 1984 entitled "Socket for Snap Fastener, now abandoned."

FIELD OF THE INVENTION

This invention relates to a socket of a snap fastener for garments.

BACKGROUND OF THE INVENTION

Snap fasteners of varied types are known in the art, and the present invention is concerned with improvements in the so-called spring socket type. FIG. 1 illustrates a conventional snap fastener of this type, which comprises a spring socket 1, a stud 2 to snap in the socket, and pronged backing members 3, 4 for securing, respectively, the socket and the stud to opposed parts of a garment. The socket 1 has inwardly protruding split spring flaps 5, each of which terminates with a bead-like tongue 6 and can elastically engage with, and disengage from, an outwardly protruding bead 7 of the stud 2. The socket 1 and the stud 2 are formed, respectively, with inwardly curved guide rims 8,9. When attaching these members to a garment, the legs (prongs) 10 of the backing members are forced through opposed parts of the cloth until they are pressed against and bent at the tips against the guide rims 8,9.

The spring socket 1 and the stud 2, when thus attached to the garment and engaged together, are subject to tensions from the cloth that act on their sides (on the left and right as viewed in FIG. 1). For this reason the tongues 6 often become permanently deformed after long-time service.

When the stud 2 is fit in the socket and pulled horizontally the flaps 5 flex and contact the rear wall of the flaps. The flexing of the flaps 5 is still within the elastic deformation. When the horizontal pulling force exceeds a given level, the tongues 6 become permanently deformed. In actual use, this deformation will occur in various portions and, after a long period of use, will lead to loosening of the socket hole defined by the tongues 6. This deformation occurs because the back side of the tongues 6 directly engages the rim portion of the socket which is rigid and the stud 7 forces the tongues horizontally to and against the rim portion to cause deformation.

Moreover, the spring socket of the construction described has a mostly curved surface, leaving too little a flat surface to bear characters, trademark, symbol, or other insignia.

THE OBJECT OF THE INVENTION

Therefore, it is an object of the present invention to provide a spring socket with extended spring life. An incidental object of the invention is to provide a spring socket having an adequate surface area to bear designs, characters or the like.

DETAILED DESCRIPTION OF THE INVENTION

The present invention will now be described in detail in connection with preferred embodiments, with references to the accompanying drawings.

Figure 1:
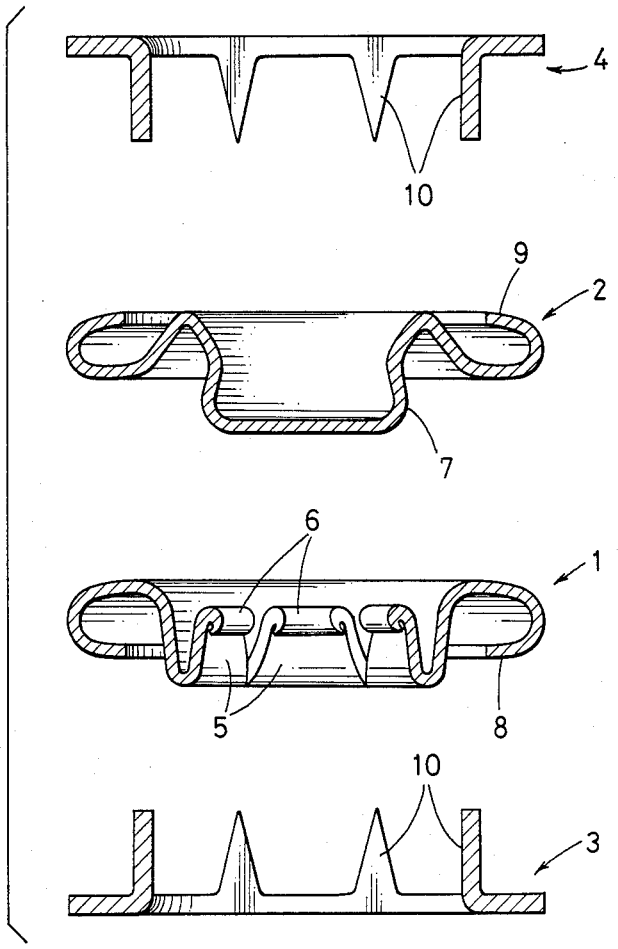
FIG. 1 PRIOR ART
FIG. 1 is a sectional view of typical components to be assembled into a conventional snap fastener.
Figure 2:
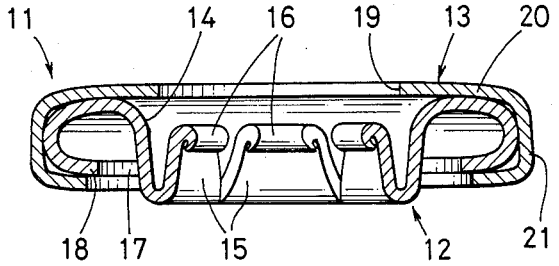
FIG. 2 is a sectional view of a spring socket as an embodiment of this invention.

FIG. 2 shows a metal spring socket 11 as an embodiment of the invention. It comprises a spring button part 12 and a cover 13. The spring button part 12, built in the same manner as the spring socket 1 in FIG. 1, includes an annular base 14, spring flaps 15 protruding inwardly and upwardly as if split from an inward and downward extension of the base, and beadlike tongues 16 formed at the tips of the flaps and disposed in a generally circular arrangement. The cover plate or cover 13 is spaced upwardly from the tongues 16 so as to allow the tongues 16 to clear the cover plate 13 at any flexing position of the tongues 16. The tongues 16 are formed in the locations where the outwardly protruding head (indicated at 7 in FIG. 1) of this stud can snap in position. The button part 12 also curvedly extends downwardly and inwardly from the annular base 14 to form an opening 17, through which the legs (10 in FIG. 1) of its associated backing member is introduced and a guide rim or seat 18 for securely receiving the legs in place. The cover 13 consists of a disc portion 20 having a center opening 19 of a larger diameter than the circle that the tongues 16 of the button part define combinedly and a retaining flange 21 formed integrally with the disc portion to embrace the peripheral portion of the button part. The diameter of the opening 19 is chosen so that, when the forces exerted sideways (on the left and right as viewed in FIG. 2) due to engagement of the socket 11 with the stud in use are excessive, the opening will be small enough for its edge to come into contact with the outwardly protruding head of the stud to restrict the stud motion and prevent permanent deformation of the tongues 16, whereas the opening will be large enough to permit unobstructed functioning of the tongues and the spring flaps 15. Determination of such optimum dimensions is a matter of designing and can be easily done empirically.

Figure 3:
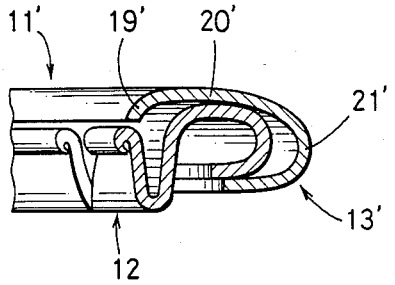
FIG. 3 is a sectional view of a spring socket as another embodiment of the invention.

FIG. 3 shows a spring socket 11' as another embodiment of the invention. A spring button part 12 is fabricated in the same way as in FIG. 2. A cover 13' is generally ring-shaped, including an opening 19', a flat disc-shaped portion 20', and a retaining flange 21' embracing the peripheral portion of the button part 12. In this embodiment, the opening 19' is tapered so as to guide the protruding head of the stud, and a circular space is provided between the flange 21' and the outer periphery of the button part 12 to enlarge the flat disc-shaped portion 20' accordingly. Other particulars are the same as those of the preceding embodiment.

With the construction so far described, the spring socket of the invention is advantageous in that, when used with the stud by snapping into and out of mutual engagement, the edge of the cover opening restricts any excessive forces which the protruding head of the stud would apply to the tongues 16 of the socket, thus protecting the tongues from such forces. A secondary advantage of the invention is that the surfaces 20, 20' of the covers 13, 13' are flat and broad enough to bear design, mark, or other insignia.

I claim:

1. A socket constituting the female member of a snap fastener, which comprises a metal spring button part including an annular base, an inner portion extending inwardly and downwardly from the inner portion of said annular base, and further extending inwardly and upwardly and split into flaps which terminate with tongues arranged circularly for elastic engagement with a stud as the male member of the snap fastener, an outer portion curvedly extending outwardly and downwardly from the outer portion of said annular base and then inwardly to form portions to guide and receive the legs of a backing member of the snap fastener, and a cover plate having a circular opening of a larger diameter than the inside diameter of the circle defined by said tongues, said cover plate being secured to the periphery on the tongue side of said annular base, said cover plate being upwardly spaced from said tongues so as to allow said tongues to clear said cover plate at any flexing position of said tongues.

2. A socket according to claim 1, wherein the circular opening of said cover is provided with a tapered edge.

3. A socket according to claim 1, wherein the circular opening of said cover is large enough to allow the elastic engagement of said tongues with said stud but small enough to prevent the tongues from being permanently deformed.

4. A socket according to claim 2, wherein the circular opening of said cover is large enough to allow the elastic engagement of said tongues with said stud but small enough to prevent the tongues from being permanently deformed.

* * * * *